United States Patent [19]

Dupre

[11] Patent Number: 4,627,127

[45] Date of Patent: Dec. 9, 1986

[54] CYLINDRICAL BRUSH

[75] Inventor: Eugene J. Dupre, Somerset, Wis.

[73] Assignee: Minnesota Mining and Manufacturing Company, St. Paul, Minn.

[21] Appl. No.: 701,103

[22] Filed: Feb. 13, 1985

[51] Int. Cl.[4] ..... A46B 3/02; A46B 7/10; A46D 3/00

[52] U.S. Cl. ..... 15/179; 15/182; 15/230.13; 29/127; 29/148.4 D; 156/194; 300/21; 5/403

[58] Field of Search ..... 15/179, 180, 181, 182, 15/230, 230.13, 213; 29/120, 121.4, 127, 128, 148.4 D; 300/21; 51/358, 403; 156/194, 195, 190, 155, 79, 425

[56] References Cited

U.S. PATENT DOCUMENTS

| | | | |
|---|---|---|---|
| 2,447,241 | 8/1948 | Englund | 156/194 X |
| 2,879,534 | 3/1959 | Swanson et al. | 15/182 X |
| 2,995,401 | 8/1961 | Peterson | 300/21 |
| 3,030,696 | 4/1962 | Serwer | 29/127 |
| 3,107,382 | 10/1963 | Tilgner | 15/182 |
| 3,129,269 | 4/1964 | Charvat | 264/45 |
| 3,226,799 | 1/1966 | Grodberg et al. | 29/127 X |
| 3,237,233 | 3/1966 | Adams | 15/182 |
| 3,280,516 | 10/1966 | Kimmerle | 51/358 |
| 3,364,630 | 1/1968 | Rusk et al. | 51/358 |
| 3,597,787 | 8/1971 | Rosendall | 15/179 |
| 3,699,727 | 10/1972 | McDonald | 51/334 |
| 3,886,622 | 6/1975 | Horst | 15/230 |
| 4,346,494 | 8/1982 | Peabody et al. | 15/179 |
| 4,478,609 | 10/1984 | DeLigt | 51/295 |

FOREIGN PATENT DOCUMENTS

| | | | |
|---|---|---|---|
| 2506643 | 8/1976 | Fed. Rep. of Germany . | |
| 1180376 | 6/1959 | France | 156/190 |
| 842185 | 7/1960 | United Kingdom . | |
| 1332920 | 10/1973 | United Kingdom . | |

*Primary Examiner*—Peter Feldman

*Attorney, Agent, or Firm*—Donald M. Sell; James A. Smith; David L. Weinstein

[57] ABSTRACT

Cylindrical brush and method of making thereof. The brush comprises an inner layer formed from a first strip of fabric helically wound to form a hollow cylinder, an outer layer formed from a second strip of fabric helically wound over said first strip, a third layer of adhesive interposed between said first and second layers. The curve of the helix formed by the second fabric strip intersects the curve of the helix formed by said first fabric strip. The peripheral surface of the second fabric strip also has bristles attached to it.

12 Claims, 6 Drawing Figures

CYLINDRICAL BRUSH

BACKGROUND OF THE INVENTION

1. Field of the Invention

The present invention relates to cylindrical brushes and method of making thereof.

2. Description of the Prior Art

Various powered machines utilize cylindrical brushes having different degrees of abrasiveness. These brushes are generally in the form of elongated cylinders having a void in the interior portion thereof. Large hollow cylinders, e.g. those having length to diameter ratio of greater than 2:1 experience deflection in the area of the center of the cylinder because the strength of the material making up the solid portion of the cylinder is generally relatively low in relation to its weight.

Currently, rigid cores are inserted into the hollow cylinder to provide support therefor and minimize or eliminate deflection. However, the use of rigid cores is not desired for at least some of the following reasons:

(1) If the brush manufacturer supplies the core, overall cost of the brush will be relatively high, as the core has little or no salvage value at the end of the useful life of the brush portion;

(2) If the brush user supplies his own core, the outside diameter of the core must be compatible with the inside diameter of the hollow, cylindrical brush, or else the brush cannot be used.

(3) If the rigid core is too heavy, the costs of shipping and handling will be excessive.

SUMMARY OF THE INVENTION

This invention involves a cylindrical brush comprising an inner layer formed from a first strip of fabric material helically wound to form a hollow cylinder, a layer of adhesive material applied over the outer periphery of the thus-formed cylinder, and an outer layer formed from a second strip of fabric material helically wound over said adhesive layer and around the cylinder formed from said first fabric strip to overlap same, the curves formed by the helical windings of said first fabric strip and said second fabric strip intersecting. The layer of adhesive material must be included between the layer formed from the first strip of fabric material and the layer formed from the second strip of fabric material to provide support and strength to the hollow cylindrical brush. The hollow core of the cylindrical brush can remain open or it can be permanently or temporarily filled with a solid material such as a rigid polymeric material like polyurethane, which can be bored to accommodate a smaller diameter arbor, or it can be fitted with a removable mechanical roll mounting device such as an expanding mandrel. The surface of the second strip of fabric material that is not facing the first strip of fabric material includes a brush element such as provided by closely spaced, erect bristles or the like attached to the second strip or to a carrier strip mounted thereon. In another aspect of this invention, methods are provided for preparing the unfilled and filled embodiments of the cylindrical brush previously described.

The cylindrical brush of the present invention can be prepared so as to exhibit a high level of strength in relation to its weight by filling the hollow core of the brush with a polymeric material, thus providing a relatively inexpensive alternative to a rigid metal core. In addition, the polymeric material used to fill the core can be prepared so as to allow the cylindrical brush to be mounted on a shaft having an outside diameter that is smaller than the inside diameter of the brush.

Unlike cylindrical brushes of the prior art, the brush of the present invention is resistant to deflection along its major axis.

DETAILED DESCRIPTION

Figure 1:
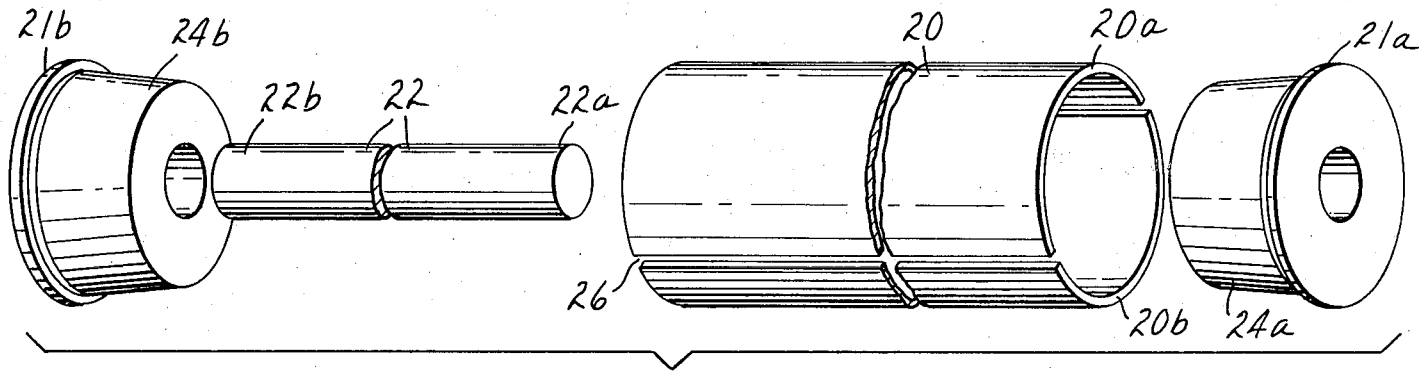
FIG. 1 is an exploded view of equipment that can be used to prepare the hollow, cylindrical brush of the present invention.
Figure 2:
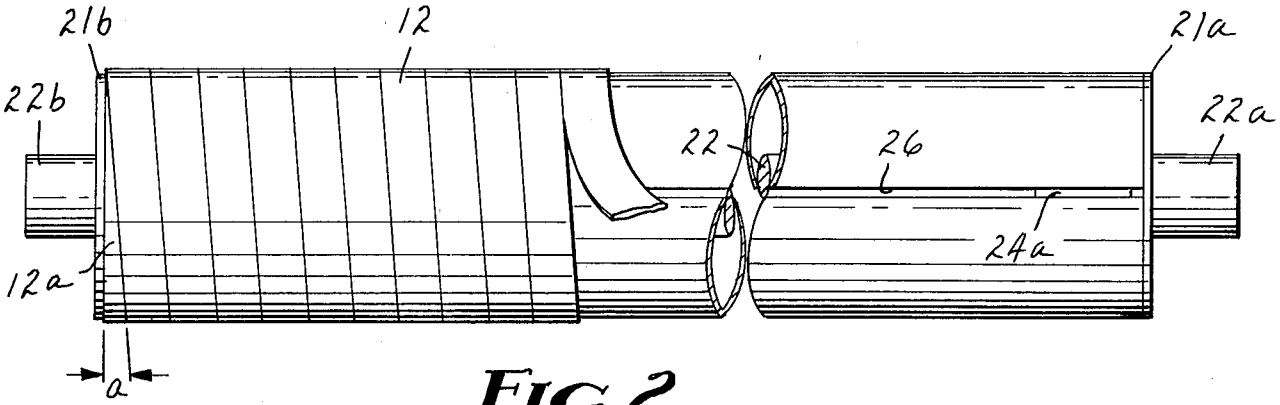
FIG. 2 is a schematic view of the first strip of fabric material partially wound about the equipment of FIG. 1.
Figure 3:
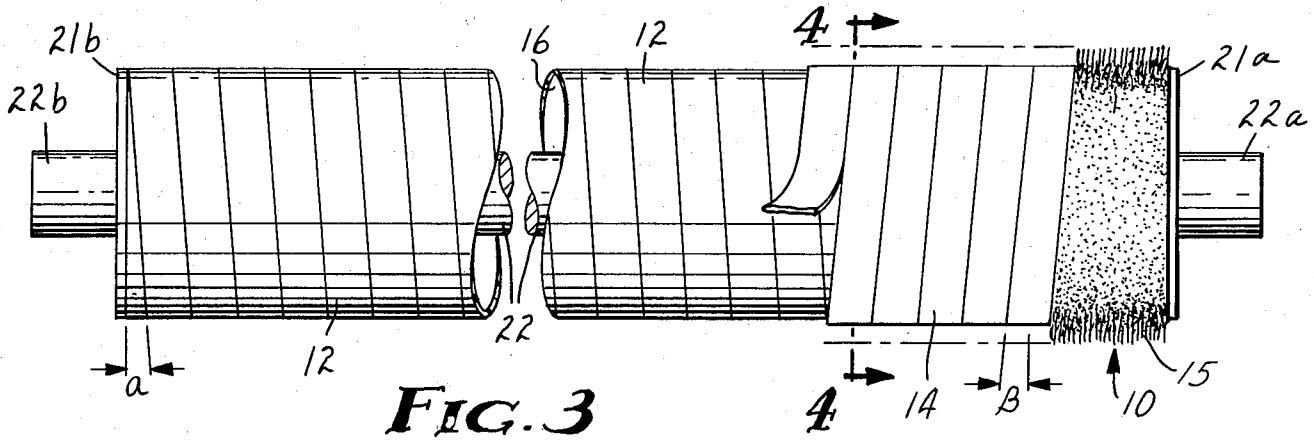
FIG. 3 is a schematic view of the second strip of fabric material partially wound over the first strip of fabric material.
Figure 4:
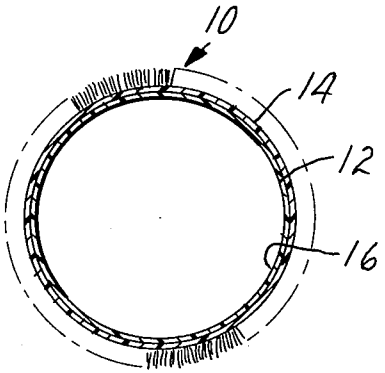
FIG. 4 is a cross-sectional view taken of the brush of the invention along line 4—4 of FIG. 3 the completed hollow, cylindrical brush.

Each of the embodiments of the cylindrical brush 10 this invention comprise an inner layer formed from a first fabric strip 12 wrapped in a helix to form a hollow cylinder, an outer layer formed from a second fabric strip 14 wrapped in a helix about the first fabric strip 12, and a layer of adhesive material interposed between and joining the first fabric strip and the second fabric strip. As used herein, the term "helix" means a curve traced on a cylinder by the rotation of a point crossing its right sections at a constant oblique angle, or a space curve with turns of constant slope from the base and constant distance from the axis, or the curve described by the thread of a bolt or by a tubular oil spring, or broadly, a three-dimensional curve with one or more turns around an axis (as the space curve described by a conical coil spring) to overlap same. The first fabric strip 12 and the second fabric strip 14 are wound so that the curves traced on the cylinder by the two fabric strips intersect, i.e. are not parallel. In a preferred embodiment of the invention, the hollow interior portion 16 of the cylindrical brush 10 is filled with a hard synthetic, polymeric material. Alternatively, the hollow interior portion 16 of the cylindrical brush 10 can remain unfilled.

The first fabric strip 12 is preferably made of a low-stretch cloth. The cloth should have a tensile strength greater than 200 psi with less than 8% stretch per inch at 100 lbs. load so that it will be able to withstand forces expected to be encountered in normal use. Representative examples of cloth materials suitable for the first fabric strip 12 include a 100% high tenacity spun polyester plain weave cloth with 6/2 ply warp and fill with a thread count of 24×24 or greater.

The second fabric strip 14 should preferably meet the same strength and stretch requirements as the first strip 12. However, the second fabric stirp can have lower strength and stretch characteristics than the first strip, so long as these characteristics are adequate for the intended use. Representative examples of cloth materials suitable for the second fabric strip 14 include the same polyester cloth described as being useful for strip 12.

The width of each of the fabric strips 12 and 14 should be no greater than half the axial length of the cylindrical brush formed therefrom to provide at least one full period of helix for each fabric layer. Preferably a plurality of periods of helix should be present for each fabric layer.

The length of each of the fabric strips 12 and 14 should be sufficient to provide at least one full period of helix, and preferably a plurality of periods of helix, for each fabric layer. The elongate sides of each of the fabric strips 12 and 14 should be parallel so that when strips 12 and 14 have been wound in a helical configuration, adjacent coils of the helix will abut to provide a substantially continuous cylindrical surface. The helix formed from strip 12 is preferably wound in the opposite direction from the helix formed from strip 14, i.e., if the helix from strip 12 forms a right-hand screw analog, the helix from strip 14 should form a left-hand screw analog. The advantage of the helixes being wound in opposite directions is that such a manner of winding provides more uniformity with respect to strength in all regions of the cylindrical brush. Furthermore, winding of the helixes in opposite directions allows greater margin of error to operators engaged in the winding operation. For example, if both the inner and outer strips were wound in the same direction, there is a greater possibility that the operator may fail to completely cover the space between the coils of the inner layer with the strip that forms the outer layer than if the inner and outer strips were wound in opposite directions.

The fabric strip 14 preferably contains bristles 15 on the outer peripheral surface thereof. Bristles that are suitable for the second fabric layer include 612 nylon (heat stabilized) from E. I. Du Pont de Nemours & Co., having a diameter ranging from 10 to 60 mils and abrasive grades ranging from 500 to 60. Alternatively, a carrier strip containing bristles can be mounted on the fabric layer formed by strip 14.

The second fabric strip 14 is adhered to the first fabric strip, preferably by means of an adhesive, such as polyurethane. A layer of adhesive material (not shown) is applied to either the first fabric strip 12 or the second fabric strip 14 or to both strips 12 and 14 before the second fabric strip is wrapped about the layer formed from the first fabric strip. The adhesive serves the twofold purpose of (1) adhering strip 12 to strip 14 and (2) providing support and strength to the composite cylinder. The adhesive should preferably have a 90° peel test value of at least 10 lb./in. width at 20° C. Adhesive materials that are suitable for the adhesive layer of the cylindrical brush include polyether polyurethane resins having a 92 Durometer A hardness when cured. Such a resin can be formed by reacting 100 parts of of a diphenylmethane 4,4'-diisocyanate (MDI) based polyoxytetramethylene urethane prepolymer having 8.3% isocyanate, cured with 8.7 parts of 1,4-butanediol containing stannous chloride.

If the cylindrical brush remains unfilled, it can be utilized by being mounted on an expandable mandrel. An expandable mandrel is a wheel or cylinder that fits inside a hollow cylinder. The mandrel can be expanded to hold the cylindrical brush firmly during operation. This can be done pneumatically with inflatable mandrels or by individual rubber segments that flex outward due to centrifugal force. The outward flexing of the rubber segments prevents the cylindrical brush from collapsing inwardly from the force of the surface being brushed.

If the hollow interior portion 16 of the cylindrical brush is filled, it is preferred that the fill material 17 be of such a physical nature and of such a thickness that inward collapsing will be prevented during operation. Polymeric fill material is preferred. It has been found that a thickness of at least 2.5 inches of rigid polyurethane foam provides sufficient strength for most foreseeable uses. As used herein, the term "rigid polyurethane foam" means polyurethane foam having a density of approximately 2 to approximately 6 pounds per cubic foot, preferably about 5.7 to about 6 pounds per cubic foot, and a compressive strength at 10% deflection of at least about 40 psi, preferably of at least about 100 psi. Cylinders having a high length to diameter ratio, greater than about 6:1, could require a foam thickness greater than 2.5 inches whereas cylinders having a low length to diameter ratio, less than about 2:1, would be useful with a foam thickness less than 2.5 inches. The foam material is preferably inexpensive, strong, and curable under ambient conditions, e.g., room temperature (20°–25° C.), or with moderate heating.

For commercial purposes, the cylindrical brush having an interior filled with polyurethane foam or the like will be only partially filled so that the brush will have a hollow core 18, the diameter of which core can vary from brush to brush. The hollow core 18 must be of sufficient diameter to accept shafts from powered machines, and it can have a greater diameter than rotatable shafts upon which it is to be mounted.

The cylindrical brush containing the partially-filled core can be mounted on the shaft of a powered machine by mating shaped bodies attached to the ends of the shaft with impressions 19 in the polymeric material located at the ends of the cylindrical brush. The impressions 19 are designed so as to accommodate the shaped bodies on the ends of the shaft of powered machines.

The brush 10 can be prepared by first providing a mandrel 20 that is removable from the hollow cylindrical interior portion 16 after the brush 10 is formed.

The mandrel 20 for preparing the hollow cylindrical brush 10 can be prepared by cutting a length of cylindrical pipe longitudinally to form two portions **20*a*, 20*b***, preferably but not necessarily of equal size. More than two longitudinal portions can be used. The length of the pipe can vary, but is generally between 2 to 8 feet.

Two end pieces **21*a*, 21*b*, preferably of conical shape, are mounted on a shaft 22, the tapered ends 24*a*, 24*b* of the conical end pieces being attached to the ends 22*a*, 22*b* of the shaft 22. The purpose of the end pieces is to separate the portions 20*a*, 20*b* during the preparation of the hollow cylindrical brush 10. The two cylindrical pipe portions 20*a*, 20*b* are secured to the end pieces 21*a*, 21*b* by means of removable fasteners, e.g. rubber bands, tape, screws, rivets (not shown). A gap 26 should exist between the two cylindrical pipe portions 20*a*, 20*b* when they are secured to the end pieces 21*a*, 21*b*. The gap 26 is required so that the cylinder formed by the two pipe portions 20*a*, 20*b* will collapse when the end pieces 21*a*, 21*b* are removed from the ends 22*a*, 22*b* of the shaft 22**.

The shaft 22 is then mounted into a lathe (not shown). A strip of fabric material 12 is wound about the mandrel 20 to form a helix. The width of the strip can vary, preferably ranging from about 0.5 to about 6 inches. The ends **12*a*** of the fabric material can be held in place by suitable fasteners (not shown), e.g. rivets, screws, staples, and the like.

A strip of fabric material 14 is wound about the mandrel 20 over the first strip 12 of fabric to form a helix. The curves of the helixes of first fabric strip 12 and second fabric strip 14 must intersect. The slope of each of the curves that forms each of the helixes is essentially constant with respect to the base of the cylindrical brush, and the angles between the curves that form the helixes and the base of the cylindrical, which angles are designated by letters $\alpha$(alpha) and $\beta$(beta), can range from about 0.75° to about 72°, and are preferably between about 1.5° to about 19°. The slopes of the curves that form each of the helixes can be the same or different. Prior to the winding of fabric strip 14 over fabric strip 12, an adhesive material should be applied between strips 12 and 14, either to strip 12, strip 14, or both. The adhesive can be applied with a notched trowel. The assembly is preferably cured in air or in an oven at a temperature of up to 250° F. to set the adhesive.

After curing, the end pieces 21*a*, 21*b* are removed from the ends 22*a*, 22*b* of the shaft 22, and the two cylindrical pipe portions 20*a*, 20*b* are collapsed and removed, leaving a cylindrical brush having a hollow cylindrical interior portion 16. The ends of the brush 10 can then be cut to provide a brush having the desired length.

Figure 6:
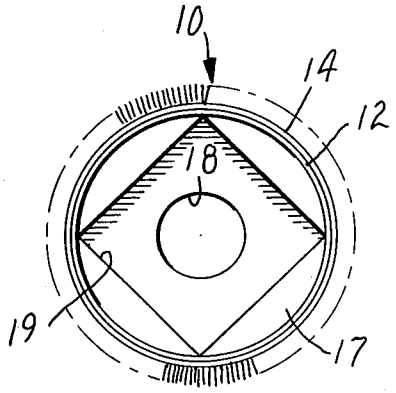
FIG. 6 is an end view of the cylindrical brush having core that has been filled with polymeric material.
Figure 5:
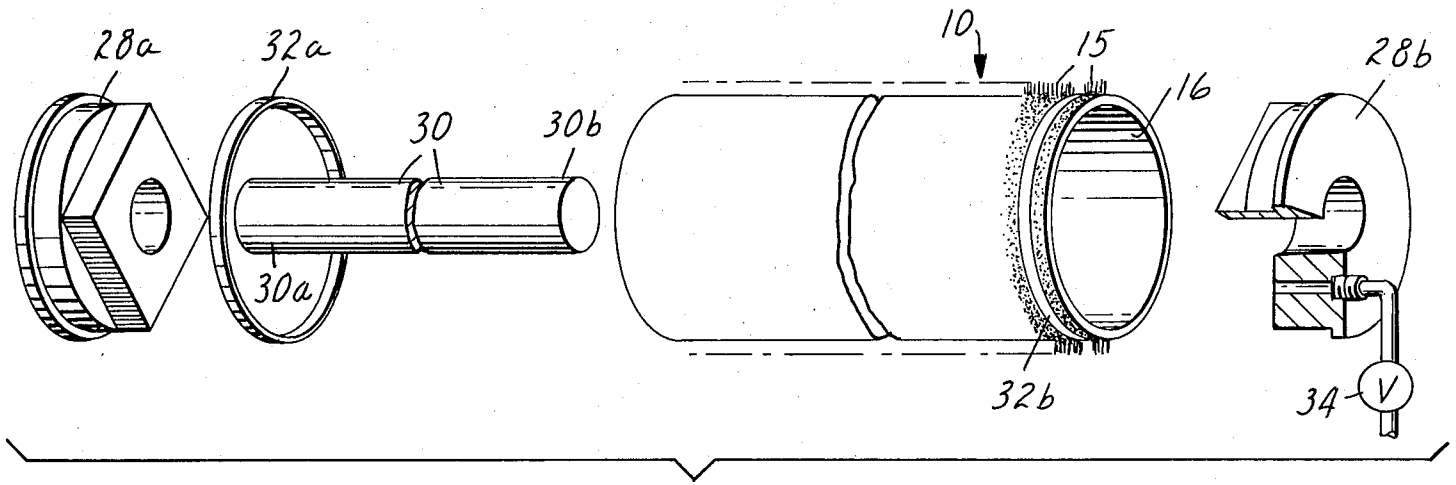
FIG. 5 is an exploded view of equipment that can be used to prepare a cylindrical brush having a core filled with polymeric material.

The brush 10 can be filled with a polymeric material 17 by means of the following method. The hollow cylindrical brush 10 previously described is mounted on an end plate 28*a*, which is then mounted on a shaft 30 at one end 30*a* thereof. The surfaces of the end plates 28*a*, 28*b* and the shaft 30 that will come in contact with the polymeric material are preferably covered with a release agent to allow easy removal after the polymeric material has set. The diameter of shaft 30 is sufficiently large so that a center hole 31 will be produced capable of fitting shafts of powered machines. Reactants for forming the polymeric material are mixed together and poured into the hollow interior portion 16 of the brush 10. The second end plate 28*b* is set in place and secured to the shaft 30 at end 30*b* thereof. Bands 32*a*, 32*b* are put around each end of the brush 10 and tightened to prevent the evolving polymeric material from exuding between the cylindrical brush 10 and the end plates 28*a*, 28*b*. A valve 34 is provided in the second end plate 28*b* to allow gas to escape as the polymeric material expands. Sufficient pressure is maintained in the brush 10 to insure that the polymeric material will have uniform cell size and no large voids. In approximately five minutes the polymeric material rises to the top of the cylindrical brush at which time the polymeric material is ready for post cure. The polymeric material can be postcured by heating to 200° F. for one hour after which it can be cured at 250° F. for two hours. The end plates 28*a*, 28*b* and the center shaft 30 are then removed, leaving the completed cylindrical brush 35 having a core partially filled with a polymeric material 17 as shown in FIG. 6. The end pieces 28*a*, 28*b* can be of such a configuration that they form impressions 19 in the polymeric material upon removal therefrom. These impressions 19 are capable of receiving shaped bodies that are attached to the ends of a shaft of a powered machine. By this manner of design, shafts having a smaller diameter than the hollow core 18 of the filled brush can be used to rotate the brush.

While any suitable curable, synthetic resinous composition, or other curable material, can be used to fill the hollow interior portion of the hollow cylindrical brush 10 of the present invention, it will in most instances be desired to make the polymeric core from a foamable thermal setting resin, particularly where the articles are to be used for abrasive rolls and the like, so that the material will not be softened by the heat that is produced during abrading operations.

A suitable foam material can be made using a resin composition containing the following ingredients:

| Ingredient | Percent by weight |
|---|---|
| isocyanate prepolymer | 58 |
| polyol | 40 |
| surfactant | 0.8 |
| water | 0.5 |
| catalyst | 0.3 |

The above resin composition is caused to foam by the reaction of the water with the isocyanate. By way of example, a suitable foaming mixture can be prepared by using a two-part composition, the first part (Part A) consisting of 98% polyol, 0.6% catalyst, and 1.4% water, the second part (Part B) consisting of 98.7% isocyanate prepolymer and 1.3% surfactant.

Approximately seventy parts by weight of Part A and approximately one hundred parts by weight of Part B are blended together for from one to two minutes. The foam preferably has a density of approximately 5.7 to 6.0 pounds per cubic foot.

In general the density of the foam which is used can be varied depending upon the unit load that is to be applied to the roll during use. The foam material must not be deformed beyond the yield point in most instances, and generally speaking the yield strength increases with the density for a given type of foam material. Foam materials having a density greater than approximately one pound per cubic foot will be required for most applications, and densities as high as approximately 20 pounds per cubic foot may be required for some applications. For most applications, however, densities of from approximately 2 to approximately 6 pounds per cubic foot will provide the necessary strength. For those applications where uneven surfaces are to be sanded, it will be highly desirable to use a resiliently deformable foam that will conform to uneven surface configurations being sanded without being loaded beyond the yield point, and which will recover its original shape when the load is removed from the cylindrical brush.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A cylindrical brush comprising (a) an inner layer comprising a first elongate fabric strip formed of low-stretch cloth having a tensile strength greater than 200 psi and less than 8% stretch at 100 lbs. load and having parallel sides wound into a first helix with adjacent coils in said first helix abutting to provide a cylindrical shell having a hollow core, (b) an outer layer comprising a second elongate fabric strip having parallel sides wound into a second helix with adjacent coils in said second helix abutting to provide a substantially continuous outer surface, said outer layer contacting and overlapping said inner layer, the curve formed by said second helix intersecting the curve formed by said first helix, (c) adhesive material interposed between said layers to adherently bond together said inner layer and said outer layer; and (d) bristles fastened to and covering at least a portion of the outer surface of said outer layer.

2. A brush according to claim 1 being in the form of a hollow cylinder.

3. A brush according to claim 2 wherein said hollow cylinder is at least partially filled with a solid material.

4. A brush according to claim 3 wherein said hollow cylinder is at least partially filled with a solid polymeric material.

5. A brush according to claim 1 wherin the angles between curves that form each of the helixes and the base of the cylindrical roll independently range from about 0.75° to about 72°.

6. A brush according to claim 1 wherein said first strip and said second strip are helically wound in opposite directions.

7. Method of preparing a cylindrical brush comprising the steps of:

(a) providing a cylindrical mandrel having two ends and comprising a plurality of separable elongated elements, which elements, when separated, form a circumferential plane having greater circumference than when unseparated, (b) inserting at each end of said mandrel a means for separating said elongated elements, (c) winding a first elongate fabric strip formed of low-stretch cloth having a tensile strength greater than 200 psi and less than 8% stretch at 100 lbs. load helically around said mandrel and in contact therewith, (d) applying to at least one of said first fabric strip or to a second elongate fabric strip a curable adhesive material, (e) while said adhesive material is still uncured, winding said second elongate fabric strip helically over said first strip and in contact therewith, the curve of said first helix intersecting the curve of said second helix, said first strip and said second strip forming a hollow cylinder, (f) curing said adhesive material to form an adherent bond between said first fabric strip and said second fabric strip, (g) removing aaid separating means to allow said elongated elements to become unseparated, (h) removing said mandrel from said hollow cylinder.

8. The method of claim 7 wherein said adhesive is cured after said second fabric strip is wound over said first fabric strip.

9. The method of claim 7 wherein said cylinder having said voided interior is cut to the desired length.

10. The method of claim 7 further including the step of at least partially filling said voided interior with a solid polymeric material.

11. The method of claim 10 wherein said polymeric material is formed by reacting polymer-forming rectants in the voided interior.

12. The method of claim 7 wherein said first fabric strip and said second fabric strip are wound in opposite directions.

* * * * *